US007015188B2

(12) United States Patent
Adama et al.

(10) Patent No.: US 7,015,188 B2
(45) Date of Patent: Mar. 21, 2006

(54) FABRIC CONDITIONING COMPOSITIONS

(75) Inventors: Amanda Jane Adama, Wirral (GB); Craig Warren Jones, Wirral (GB); Marie Anne Maxwell, Wirral (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 221 days.

(21) Appl. No.: 10/311,458

(22) PCT Filed: Jun. 12, 2001

(86) PCT No.: PCT/EP01/06643

§ 371 (c)(1),
(2), (4) Date: Jun. 9, 2003

(87) PCT Pub. No.: WO01/96510

PCT Pub. Date: Dec. 20, 2001

(65) Prior Publication Data

US 2004/0033931 A1 Feb. 19, 2004

(30) Foreign Application Priority Data

Jun. 16, 2000 (GB) ..... 0014891

(51) Int. Cl.
*C11D 1/835* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS 6,323,167 B1 * 11/2001 Franklin et al. ..... 510/123

FOREIGN PATENT DOCUMENTS

| | | |
|---|---|---|
| DE | 196 23 764 A1 | 12/1997 |
| DE | 199 39 536 A1 | 2/2001 |
| EP | 0 032 267 A1 | 7/1981 |
| EP | 0 059 502 A1 | 9/1982 |
| EP | 0 128 231 A1 | 12/1984 |
| EP | 0 079 746 B1 | 2/1988 |
| EP | 0 569 847 A1 | 11/1993 |
| FR | 2 540 901 | 8/1984 |
| GB | 1 601 360 | 10/1981 |
| WO | 96/14375 | 5/1996 |
| WO | 97/47723 | 12/1997 |
| WO | 98/23808 | 6/1998 |
| WO | 99/31216 | 6/1999 |

OTHER PUBLICATIONS

International Search Report No. PCT/EP 01/06643, dated Nov. 5, 2001—3 pp.
UK Search Report No. GB0014891.6 dated Aug. 9, 2000—1 p.
Chemical Abstracts, vol. 110, No. 10—of JP 63-219680 (attached).
WPI Derwent Abstract No. XP002180720 of JP 04136270.

* cited by examiner

*Primary Examiner*—John R. Hardee

(74) *Attorney, Agent, or Firm*—Ellen Plotkin

(57) ABSTRACT

A fabric softening composition comprises a cationic fabric softening compound comprising 2 or more long hydrocarbyl chains, an oil comprising from 8 to 40 carbon atoms, a nonionic stabiliser comprising a nonionic alkoxylate having an average alkoxylation number of from 10 to 40 wherein the composition is in the form of a macroemulsion. A method for softening fabrics comprises adding the fabric softening composition to a laundry operation.

5 Claims, No Drawings

FABRIC CONDITIONING COMPOSITIONS

FIELD OF THE INVENTION

The present invention relates to fabric softening compositions, and to a process for their production.

BACKGROUND OF THE INVENTION

Fabric softening compositions are well known. Such compositions typically comprise a cationic or nonionic softening agent dispersed in water. When the level of softening agent is present in an amount up to 8% by weight, the compositions are considered dilute, and at levels from 8% to 60%, the compositions are considered concentrated. Usually, such conditioners are termed "rinse-added" since they are added into the wash during the rinse cycle.

It is known that concentrated fabric softening compositions can suffer from instability on storage. This can manifest itself as an irreversible thickening of the composition to the point where the composition gels and is no longer pourable.

To address this, nonionic alkoxylated alcohols can be provided in fabric softening compositions as a viscosity stabiliser for the composition. Such compounds are referred to herein as "nonionic stabilisers".

However, the presence of nonionic stabilisers can adversely affect softening performance, and the greater the amount of nonionic stabiliser present, the more adverse the effect on the softening performance can be.

Therefore, it is desirable to provide fabric softening compositions which are stabilised by nonionic stabilisers but which maintain, or even increase their softening performance in the presence of such compounds.

FR 2540901 discloses a composition for conditioning textiles comprising a cationic softening compound and optionally fluid oils, e.g. Vaseline (RTM) oil.

EP-A1-0059502 discloses dilute softening compositions comprising 0.5 to 5% of oil and 0.1 to 2% of an ammonium surfactant having an alkoxylation number of from 1 to 9.

GB 1601360 discloses a softening composition comprising a cationic fabric softener and a $C_{10-40}$ hydrocarbon, and teaches that the hydrocarbon is a cheaper replacement for nonionic materials previously proposed for use with the cationic fabric softener.

EP-A1-0079746 discloses a concentrate comprising a cationic fabric softener, a $C_{10-40}$ hydrocarbon and an organic solvent.

EP-A1-0032267 discloses a softening composition comprising a cationic softener, a $C_{12-40}$ hydrocarbon and an amine derivative compound.

EP-A1-0569847 relates to nitrogen free softening agents containing alkoxylated fats or oils. There is no disclosure of either the nonionic alkoxylates or the level of alkoxylation specified in the present invention.

WO-A1-96/14375 relates to compositions for the after-treatment of washed laundry comprising 0.1 to 30 wt % of a water insoluble quaternary ammonium compound, 0.1 to 50 wt % of a water soluble quaternary ammonium compound, 0 to 5 wt % of a terpene or terpene-containing compound, 0.1 to 20 wt % of an acid and 0.1 to 20 wt % of an emulsifier. The compositions are in the form of dispersions or clear solubilizates.

None of these documents solves the problem of providing a stabilised fabric softening composition which delivers maintained or improved softening performance.

A further problem associated with conventional concentrated fabric softening compositions is that the perfume intensity on fabric treated with the fabric softening composition decreases significantly during storage of the fabric. However, perfume intensity upon storage of treated fabric is desired by consumers.

Therefore, it is desirable to provide a fabric softening composition which provides fabrics with a more intense perfume upon storage of the fabrics.

OBJECTS OF THE INVENTION

The present invention seeks to address one or more of the above-mentioned problems typically associated with known fabric conditioners, and, to give one or more of the above-mentioned benefits desired by consumers.

It has now been found that, by including one or more specific oils and one or more specific nonionic stabilisers in a fabric softening composition, the composition has a stable viscosity and provides surprisingly good fabric softening effects.

The compositions are also found to have surprisingly good dispersibility in water and, when the compositions comprise perfume, they are found to provide fabric with a more intense perfumed effect upon storage of the fabric.

SUMMARY OF THE INVENTION

Thus, according to the present invention there is provided an aqueous fabric softening composition comprising:

(i) one or more cationic fabric softening agents comprising two or more long hydrocarbyl chains;

(ii) one or more oils comprising from 8 to 40 carbon atoms; and (iii) one or more nonionic stabilisers comprising a nonionic alkoxylate having an average alkoxylation number of from 10 to 40;

wherein the composition is in the form of a macro-emulsion.

According to the invention, there is also provided a process for producing an aqueous fabric softening composition comprising mixing one or more cationic fabric softening agents comprising two or more long hydrocarbyl chains with one or more oils comprising from 8 to 40 carbon atoms and with one or more nonionic stabilisers comprising a nonionic alkoxylate having an average alkoxylation number of from 10 to 40 so as to form a fabric softening composition in the form of a macro-emulsion.

DETAILED DESCRIPTION OF THE INVENTION

The present invention is concerned with aqueous fabric softening compositions, comprising one or more cationic fabric softening compounds comprising two or more long hydrocarbyl chains wherein the composition is in the form of a macro-emulsion.

In the context of the present invention, the term "macro-emulsion" may be defined as a liquid product which is opaque and metastable (that is, stable over a specified temperature and time range). It does not include conventional micro-emulsions which are clear or translucent, isotropic and thermodynamically stable.

The macro-emulsions are preferably oil-in-water macro-emulsions.

Without wishing to be bound by theory, it is believed that the compositions of the invention have a physical state wherein oil droplets are stabilised within a water continuous phase by the cationic surfactants and, if present, a dispersibility aid. Typically, the oil droplets in the macro-emulsion have a diameter of between 0.1 to 40 $\mu$m. The physical structure can contain mesophases, which help to stabilise the emulsion (for an explanation of such stability see S. Friberg, L. Mandell and Larsson, J. Colloid Interface Sci., 1969, 29, 155; S. Friberg and L. Mandell, J. Pharm. Sci., 1970, 59, 1001; S. Friberg and L. Rydhag, Colloid Polym. Sci., 1971, 244, 233; N. Krog, N. M. Barford, and R. M. Sanchez, J. Disp. Sci. Technol., 1989, 10, 483).

Fabric Softening Agent

The fabric softening compositions of the present invention comprise at least one cationic fabric softening agent comprising two or more long hydrocarbyl chains.

The cationic fabric softening agent is preferably a quaternary ammonium compound.

The compound preferably comprises at least one ester link, more preferably at least two ester links as this improves the biodegradability of the compound.

Preferred quaternary ammonium compounds have a low solubility in the water. These are referred to as "substantially water insoluble" compounds and can be defined as compounds having a solubility less than $1\times10^{-3}$ wt % in demineralised water at 20° C. Preferably the cationic surfactants have a solubility less than $1\times10^{-4}$ wt %, and more preferably the cationic surfactants have a solubility at 20° C. in demineralised water from $1\times10^{-6}$ to $1\times10^{-8}$ wt %.

It is especially preferred if the fabric softening compound is a substantially water insoluble biodegradable quaternary ammonium material which comprises a compound having two $C_{8-28}$ hydrocarbyl chains connected to the quaternary nitrogen via at least one ester link.

A first preferred type of biodegradable cationic fabric softening agent for use in the invention can be represented by the Formula (I):

Formula (I)

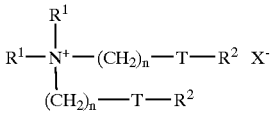

wherein each $R^1$ group is independently selected from $C_{1-4}$ alkyl, hydroxyalkyl or $C_{2-4}$ alkenyl groups; each $R^2$ group is independently selected from $C_{8-28}$ alkyl or alkenyl groups;

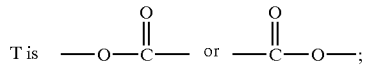

$X^-$ is any counterion compatible with the cationic surfactant, such as halides or alkyl sulphates, e.g. chloride, methyl sulphate or ethyl sulphate and n is 0 or an integer from 1 to 5.

Especially preferred materials within this formula are di-alkenyl esters of triethanol ammonium methyl sulphate and N-N-di(tallowoyloxy ethyl) N,N-dimethyl ammonium chloride. Commercial examples of compounds within this formula are TETRANYL (RTM) AOT-1 (di-oleic ester of triethanol ammonium methyl sulphate 80% active), TETRANYL AO-1(di-oleic ester of triethanol ammonium methyl sulphate 90% active), TETRANYL L1/90 (partially hardened tallow ester of triethanol ammonium methyl sulphate 90% active), TETRANYL AHT-1 (fully hardened tallow ester of triethanol ammonium methyl sulphate 90% active) TETRANYL L5/90 (palm ester of triethanol ammonium methyl sulphate 90% active (all ex Kao corporation) and REWOQUAT (RTM) WE15 ($C_{10}$–$C_{20}$ and $C_{16}$–$C_{18}$ unsaturated fatty acid reaction products with triethanolamine dimethyl sulphate quaternised 90% active), ex Witco Corporation.

A second preferred type of biodegradable cationic fabric softening agent for use in the invention can be represented by the Formula (II):

Formula (II)

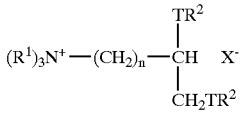

wherein $R^1$, $R^2$, n, T and $X^-$ are as defined above.

Preferred materials of this class such as 1,2 bis[tallowoyloxy]-3- trimethylammonium propane chloride and 1,2-bis [oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

It is generally preferred if the hydrocarbyl chains of the cationic fabric softening compound are predominantly linear.

One or more different types of the cationic fabric softener can be employed.

Preferably the cationic softening agent is present in an amount from 2% to 80% by weight based on the total weight of the composition. More preferably, the compositions are provided as "concentrates". Concentrates are herein defined as comprising from 8% to 60%, more preferably 9 to 25%, most preferably 10 to 22% e.g. 11 to 21% by weight of cationic fabric softening agents based on the total weight of the composition.

The iodine value of the parent fatty acyl group/acid from which the cationic fabric softening compound is formed is preferably less than 80 g $I_2$ per 100 g fatty acyl, more preferably less than 40 and most preferably from 0 to 10.

For an explanation of the method for calculating the iodine value of a compound, see our co-pending application, GB 9915964.2.

Oil

The compositions of the present invention comprise at least one oil. The oil comprises from 8 to 40 carbon atoms, preferably 11 to 30 carbon atoms, more preferably 12 to 25 carbon atoms.

Preferred oils include mineral oils, silicone oils, ester oils and/or natural oils, especially plant derived natural oils such as vegetable oils and essential oils. However, ester oils or mineral oils are preferred. Especially preferred are mineral oils.

Preferably the oil is a branched hydrocarbon with, for example, one or more branches each comprising from 1 to 5 carbon atoms attached to a backbone having from 7 to 39 carbon atoms.

It is believed that the branching enables the fabric softening composition to be formed more readily as it provides the composition with a reduced viscosity compared to compositions which contain equal amounts of unbranched oils.

If the oil is an ester oil, it is preferably hydrophobic in nature. Ester oils include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils, such as the PRIOLUBES (ex. Uniqema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407), neopentyl glycol dioleate (PRIOLUBE 1446), methyl oleate (Priolube 1400), n-butyl oleate (Priolube 1405), isobutyl oleate (Priolube 1414), propylene glycol dioleate (Priolube 1429) and isooctyl stearate (Priolube 1458) are also suitable.

Also suitable are oils available from Henkel, for example, decyl oleate (Cetiol V), glyceryl dioleate (Emerest 2419) and propyl oleate (Emerest 2302).

It is preferred that the viscosity of the ester oil is from 0.002 to 0.4 Pa.S (2 to 400 cps) at a temperature of 25° C. at $106s^{-1}$, measured using a Haake MV1 rotoviscometer, and that the density of the oil is from 0.8 to 0.9 $g.cm^{-3}$ at 25° C. The molecular weight of the ester oil is typically within the range 100 to 500.

Suitable mineral oils include the Marcol technical range and Aeroshell oils (both ex Esso) although particularly preferred is the Sirius range (ex Silkolene) or Semtol (ex. Witco Corp.).

The molecular weight of the mineral oil is typically within the range 100 to 500.

It is preferred that the viscosity of the mineral oil is from 0.002 to 1.0 Pa.S (2 to 1000 cps) at a temperature of 25° C. at $106s^{-1}$, measured using a Haake MV1 rotoviscometer, and density of the oil is from 0.8 to 0.9 g $cm^{-3}$.

Suitable vegetable oils include cotton seed oil, coconut oil, safflower oil, castor oil, corn oil, soybean oil, apricot kernel oil, palm kernel oil, sweet almond oil and sunflower oil.

One or more oils of any of the above mentioned types may be used.

The oil may be present in an amount from 6 to 40% by weight, more preferably 10 to 35% by weight, most preferably 13 to 20%, by weight, based on the total weight of the composition.

Preferably, the weight ratio of cationic softener to oil in the composition is in the range 5.1 to 1.10 more preferably 4:1 to 1:7, most preferably 3:1 to 1:5.

Nonionic Stabiliser

The fabric softening composition of the invention comprises a nonionic stabiliser comprising an average of from 10 to 40 moles of alkylene oxide per mole of the nonionic stabiliser. This is referred to herein as the alkoxylation number (of the nonionic compound).

The nonionic alkoxylate acts as a stabiliser for the composition and, in combination with the oil, also provides the composition with enhanced softening properties and good perfume intensity on treated fabric.

Suitable nonionic surfactants to act as stabilisers include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), and tallow alcohol-EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and C16 EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

The above ethoxylated nonionic surfactants are useful in the present compositions alone or in combination, and the term "nonionic surfactant" encompasses mixed nonionic surface active agents.

The average alkoxylation number is from 10 to 40, more preferably from 10 to 30, most preferably from 10 to 20 (e.g. 11 to 19).

In the compositions of the present invention, the nonionic stabiliser contributes, in combination with the oil, to improved softening of fabrics. This contribution is highly significant when the level of alkoxylation is greater than 10.

Examples of commercially available alkoxylated nonionic alcohols include: LUTENSOL (RTM) AT11 ($C_{16-18}$ fatty alcohol 11EO); LUTENSOL (RTM) A8 ($C_{12-14}$ fatty alcohol 8EO) and LUTENSOL (RTM) AT 25 ($C_{16-19}$ fatty alcohol 25EO), all ex BASF; GENAPOL (RTM) C050 (coco alcohol 5EO); GENAPOL (RTM) C100 (coco alcohol 10EO); GENAPOL (RTM) C200 (coco alcohol 20EO) and GENAPOL (RTM) T-150 (tallow alcohol 15EO), all ex Clariant; and REMCOPAL (RTM) 20, ex Elf Atochem (lauryl alcohol 19EO).

Preferably the weight ratio of oil to nonionic stabiliser in the composition is 60:1 to 1:10, more preferably 20:1 to 1:5, most preferably 10:1 to 1:1, e.g. 6:1 to 1:1.

Water

The compositions of the invention are aqueous based.

Typically, the level of water present is from 25 to 95% by weight, more preferably 40 to 85% by weight, most preferably 50 to 75% by weight, based on the total weight of the composition.

Single Long Hydrocarbyl Chain Cationic Surfactant

The compositions of the invention optionally contain a single long hydrocarbyl chain cationic surfactant.

The single long hydrocarbyl chain cationic surfactant can be employed in the formulation to aid the dispersion characteristics of the emulsion and/or to emulsify the composition, in order to form a macro-emulsion having oil droplets which are smaller than those in macro-emulsion compositions comprising the cationic fabric softening agent alone. Smaller oil droplets provide the emulsion with a homogeneous appearance which is more desirable to consumers.

The single long chain cationic surfactant is preferably a quaternary ammonium compound comprising a hydrocarbyl chain having 8 to 40 carbon atom, more preferably 8 to 30, most preferably 12 to 25 carbon atoms (e.g. quaternary ammonium compounds comprising a $C_{10-14}$ hydrocarbyl chain are especially preferred).

Examples of commercially available single long hydrocarbyl chain cationic surfactants which may be used in the compositions of the invention include; ETHOQUAD (RTM) 0/12 (oleylbis(2-hydroxyethyl)methyl ammonium chloride); ETHOQUAD (RTM) C12 (cocobis(2-hydroxyethyl)methyl ammonium chloride) and ETHOQUAD (RTM) C25 (polyoxyethylene(15)cocomethyl-ammonium chloride), all ex Akzo Nobel; SERVAMINE KAC (RTM), (cocotrimethylammonium methosulphate), ex Condea; REWOQUAT (RTM) CPEM, (coconutalkylpentaethoxymethylammonium methosulphate), ex Witco; cetyltrimethylammonium chloride (25% solution supplied by Aldrich); RADIAQUAT (RTM) 6460, (coconut oil trimethylammonium chloride), ex Fina Chemicals; NORAMIUM (RTM) MC50, (oleyltrimethylammonium chloride), ex Elf Atochem.

The single long hydrocarbyl chain cationic surfactant is preferably present in an amount from 0 to 5% by weight, more preferably 0.01 to 3% by weight, most preferably 0.5 to 2.5% by weight, based on the total weight of the composition.

Electrolyte

The fabric softening composition optionally comprises an electrolyte.

The electrolyte may be an inorganic or organic electrolyte.

Preferably the electrolyte is present in an amount from 0.001 to 1.5%, more preferably 0.01 to 1%, most preferably 0.02 to 0.7% by weight based on the total weight of the composition.

Suitable inorganic electrolytes include sodium sulphate, sodium chloride, calcium(II) chloride, magnesium(II) chloride, potassium sulphate and potassium chloride.

The electrolyte improves viscosity control (especially viscosity reduction) of the compositions and assists dispersion of the composition.

It is particularly preferred that an electrolyte is present when the amount of the cationic fabric softening compound is equal to or greater than about 13% by weight based on the total weight of the composition. Below this level of fabric softening compound, it is preferred that an electrolyte is not present in the composition.

Surfactant Co-Actives

Surfactant co-actives which enhance the softening performance of the compositions may also be incorporated in the composition in an amount from 0.01 to 20% by weight, more preferably 0.05 to 10% by weight, based on the total weight of the composition.

Preferred co-actives include fatty acids, fatty amines and fatty N-oxides.

Suitable fatty acids include stearic acid (PRIFAC 2980), myristic acid (PRIFAC 2940), lauric acid (PRIFAC 2920), palmitic acid (PRIFAC 2960), erucic acid (PRIFAC 2990), sunflower fatty acid (PRIFAC 7960), tallow acid (PRIFAC 7920), soybean fatty acid (PRIFAC 7951) all ex Uniqema and azelaic acid (EMEROX 1110) ex Henkel.

Suitable fatty amines include n-dodecylamine (ARMEEN 12D), ditallow amine (ARMEEN 2HT), cocodimethylamine (ARMEEN DMCD)-all ex Akzo Nobel; tallow polypropylene polyamine (POLYRAM S) ex Elf atochem, and di-n-octylmethylamine (RADIAMINE 6308) ex Fina Chemicals.

Suitable fatty N-oxides include cocobis(2-hydroxyethyl) amine oxide (AROMOX C/12-W) and tallowbis(2-hydroxyethyl)amine oxide (AROMOX T-12), both ex Akzo Nobel; Lauramine oxide (Emcol LO) and lauryldimethylamine oxide (L408) both ex Witco.

Perfumes

It is especially preferred that the fabric softening compositions comprise one or more perfumes which are compatible with the composition.

It has been found that the fabric softening compositions of the invention are capable of delivering to fabrics a stronger perfume intensity over a greater duration than the perfume intensity delivered by a conventional fabric softening composition.

The perfume may be present in an amount from 0.01 to 15% by weight, more preferably from 0.05 to 10% by weight, most preferably from 0.1 to 5% by weight, based on the total weight of the composition.

Other Optional Ingredients

The compositions of the invention may also contain one or more optional ingredients conventionally included in fabric softening compositions such as pH buffering agents, perfume carriers, fluorescers, colourants, hydrotropes, anti-foaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids and dyes.

Product Form

In its undiluted state at ambient temperature the product is in the form of a macro-emulsion, preferably an oil in water macro-emulsion.

The compositions are generally provided in a concentrated form but with a viscosity that is acceptable to the consumer. Preferably the compositions have a viscosity of from 0.06 Pa.S (60 cps) to 0.5 Pa.S (500 cps), more preferably 0.07 Pa.S (70 cps) to 0.2 Pa.S (200 cps), most preferably 0.08 Pa.S (80 cps) to 0.18 Pa.S (180 cps) at a shear rate of 106 $s^{-1}$ at 25° C., measured using a Haake rotoviscometer RV20 with NV cup and bob.

In the macro-emulsion, the weight average emulsion droplet size is preferably less than 20 $\mu$m, more preferably less than 5 $\mu$m (e.g. 90% of the droplets preferably have a droplet size of less than 3 $\mu$m).

Product Use

The composition is preferably used in the rinse cycle of a home textile laundering operation, where, it may be added directly in an undiluted state to the washing machine, e.g. through a dispenser drawer.

The composition may also be used in hand-laundering operations.

Composition pH

The compositions preferably have a pH of from 1.5 to 5.

Preparation of the Composition

The compositions of the invention may be prepared according to any suitable method.

Method 1

In a first method, a water seat (optionally containing a single long hydrocarbyl chain cationic surfactant) is heated to a temperature of from 50° C. to 80° C. Oil is then added under shear until a milky emulsion is formed. The double chain cationic softening agent and the nonionic alkoxylate are then melted together at between 60° C. and 80° C. for 10–20 minutes under agitation and added to the mixture. An inorganic electrolyte salt, such as calcium chloride or sodium sulphate, may also be added at this stage. The mixture is then cooled, and other optional ingredients, such as perfume are added. Optionally, the product is milled at this stage to reduce the droplet size of the emulsion formed. The milky emulsion formed by this method typically has a viscosity of 0.5 Pa.S (500 cps) or less at a shear rate of 106$s^{-1}$ at 25° C., measured using a Haake rotoviscometer RV20 with NV cup and bob. The average particle size of the emulsion droplets is preferably less than 10 $\mu$m (measured using a Malvern Mastersizer).

Method 2

In a second method, a mixture of the oil, the double chain cationic fabric softening compound and the nonionic alkoxylate are heated until a molten mixture is formed. Then, the mixture is added to an aqueous solution (optionally containing the single long hydrocarbyl chain cationic surfactant). An inorganic electrolyte salt may also be added at this stage. The mixture is then cooled, and other optional ingredients, such as perfume are added. Optionally, the product is milled at this stage to reduce the droplet size of the emulsion formed. The average particle size of the emulsion droplets formed is preferably less than 5 $\mu$m (measured using a Malvern Mastersizer).

EXAMPLES

The invention will now be illustrated by the following non-limiting examples. Further examples within the scope of the invention will be apparent to the person skilled in the art.

Examples of the invention are denoted by a number whilst comparative examples are denoted by a letter.

Unless specified otherwise, in the following tables, all amounts are percentage by weight, based on the total weight of the composition.

DEQA is 1,2-bis[tallowoyloxy]-3-trimethylammonium propane chloride:tallow fatty acid provided in a 6:1 weight ratio (ex Clariant).

SIRIUS M85 (ex Silkolene) is a branched hydrocarbon oil (average molecular weight 288).

ESTOL 1545 (ex Unichema) is octyl stearate.

Silicone 2502 (ex Dow Corning) is cetyl dimethicone.

Silicone AMS C30 (ex Dow Corning) is $C_{30-45}$ alkyl dimethicone.

GENAPOL C050 (ex Clariant) is Coco alcohol 5 EO.

GENAPOL 0070 is Coco alcohol 7 EO.

GENAPOL C100 is Coco alcohol 10 EO.

GENAPOL C150 is Coco alcohol 15 EO.

GENAPOL C200 is Coco alcohol 20 EO.

SERVAMINE KAC 458 (ex Condea) is Cocotrimethylammonium methosulphate (supplied as 45% solution).

REWOQUAT CPEM (ex Witco) is Coconutalkylpentaethoxyethylammonium methosulphate.

CTAC (ex Aldrich) is Cetyltrimethylammonium chloride.

ETHOQUAD 0/12 (ex Akzo Nobel) is Oleylbis(2-hydroxyethyl)methyl ammonium chloride.

ARQUAD 2-HT (ex Akzo Nobel) is dihardened tallow dimethyl ammonium chloride in IPA solvent provided as 75% active.

Softening Evaluation of Cloth Treated in a Tergotometer

For the softness evaluation tests (examples 1 and 2; tables 1 to 3), all compositions were prepared according to method 2 above.

A control composition comprising a commercially available concentrated fabric softening composition containing 13.5 wt % DEQA (bought in UK, February 2000) was added to 1 liter of demineralised water at ambient temperature to form a rinse liquor. The composition was dosed into a Tergotometer at a level in order to provide a theoretical deposition of the softening compound (DEQA) on the weight of fabric of 0.21 wt %.

Separately, the compositions shown in tables 1 to 3 were added to 1 liter of demineralised water at ambient temperature to form rinse liquors. The compositions were dosed into a Tergotometer at a level in order to provide a theoretical deposition of the softening compound on the weight of fabric of 0.07 wt %.

For each composition, three pieces of cloth (20 cm×20 cm) were added to the Tergotometer, the cloth having previously been rinsed for 1 minute with 0.001% wt/wt. sodium alkyl benzene sulphonate to simulate carry-over of anionic detergent from the main wash.

The cloths were rinsed for five minutes in the Tergotometer at 65 rpm, spin dried to remove excess liquor, and line dried overnight.

The softness was evaluated by a trained panel of 8 people who ranked the cloths against set standards using a numbering system ranging from 1 for an exceptionally soft cloth to 11 for exceptionally harsh cloth.

Softness results in tables 1 to 3 were evaluated as follows. Firstly, softness of the fabric treated with the control composition was rated and the average of all the scores was calculated. Then, the softness of the fabric treated with the compositions shown in tables 1 to 3 was rated and the average of all the scores was calculated. The softness results given in tables 1 to 3 represent the difference between the average softness score of the cloth treated using the control composition and the average softness score of the cloth treated with the compositions shown in tables 1 to 3.

A lower score represented better softening.

Example 1

Evaluation of Level of Oil and Nonionic Stabiliser on the Softness Performance of the Fabric Softening Compositions The softness results are given in tables 1a and 1b.

TABLE 1a

| Composition | A | B | C | D | 1 | 2 | 3 | 4 | 5 | 6 |
|---|---|---|---|---|---|---|---|---|---|---|
| DEQA | 13.5 | 13.5 | 13.5 | 13.5 | 13.5 | 13.5 | 13.5 | 0 | 0 | 0 |
| Arquad 2HT | 0 | 0 | 0 | 0 | 0 | 0 | 0 | 13.5 | 13.5 | 13.5 |
| Sirius M85 | 0 | 0 | 0 | 26.5 | 26.5 | 26.5 | 26.5 | 13.5 | 13.5 | 13.5 |
| Genapol C200 | 0 | 0.5 | 1.0 | 0 | 0.5 | 1.0 | 5.0 | 0.52 | 2.5 | 2.7 |
| Oil:NI weight ratio | N/A | N/A | N/A | N/A | 53:1 | 26.5:1 | 5.3:1 | 26:1 | 5.4:1 | 5:1 |
| Sodium sulphate[a] | 0 | 0 | 0 | 0.2 | 0.2 | 0.2 | 0.2 | 0.2 | 0.2 | 0.2 |
| Perfume | 0.9 | 0.9 | 0.9 | 2.67 | 2.67 | 2.67 | 2.67 | 2.13 | 2.13 | 2.13 |
| Water | ← To 100% → | | | | | | | | | |
| Softness results | 1.75 | 1.65 | 1.80 | 0.90 | 0.65 | 0.50 | 0.20 | 1.75 | 0.75 | 1.00 |

[a]added as a 10% aqueous solution.

The results in table la demonstrate that, in the absence of oil, no improvement in softening is observed as the level of nonionic stabiliser is increased (compositions A to C), but surprisingly, increasing the level of nonionic stabiliser in the presence of a fixed amount of oil increases the softening benefit delivered by the composition (compositions 1 to 3 and 4 to 6)

Thus, the nonionic stabiliser is observed to contribute to softening in the presence of the oil but have no effect on softening in the absence of the oil.

These results also demonstrate that better softening is delivered by compositions containing oil and a nonionic stabiliser (compositions 1 to 3) than compositions containing only the oil (composition D). This is particularly surprising as it would be expected that the presence of the nonionic stabiliser would not enhance the softness properties of the fabric softening composition.

Significantly improved softening (especially when the cationic softener is an ester quat) is observed when the weight ratio of oil to nonionic stabiliser is less than 6:1.

In table 1*b* the effect of using different oils is demonstrated.

TABLE 1b

| | Composition | | |
|---|---|---|---|
| | 7 | 8 | 9 |
| DEQA | 13.5 | 13.5 | 13.5 |
| Sirius M85 | 13.5 | 0 | 0 |
| Silicone 2502 | 0 | 13.5 | 0 |
| Silicone AMS-C30 | 0 | 0 | 13.5 |
| Genapol C200 | 2.5 | 2.5 | 2.5 |
| Servamine KAC 458 | 0.5 | 0.5 | 0.5 |
| Perfume | 2.67 | 2.67 | 2.67 |
| Water | To 100 | To 100 | To 100 |
| Softness results | 1.13 | 0.63 | 1.13 |

The results show that excellent softening is achieved across a variety of different oils.

Example 2

Evaluation of the Level of Alkoxylation of the Nonionic and Oil Concentration on Softening Performance Tables 2 and 3 further illustrate the effect of the level of nonionic stabiliser and oil concentration on the softening performance of the fabric softening compositions.

TABLE 2

| Composition | E | F | G | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|
| DEQA | 13.5 | 13.5 | 13.5 | 13.5 | 13.5 | 13.5 | 13.5 | 13.5 | 13.5 | 13.5 | 13.5 | 13.5 | 13.5 | 13.5 | 13.5 | 13.5 | 13.5 |
| Sirius M85 | | | | 13.5 | 13.5 | 13.5 | | | | | 18.5 | 18.5 | 18.5 | 26.5 | 26.5 | 26.5 | 26.5 |
| Estol 1545 | | | | | | | 13.5 | 13.5 | 13.5 | 13.5 | | | | | | | |
| Genapol C050 | 0.97 | | | | | | 0.97 | | | | 0.97 | | | 0.97 | | | |
| Genapol C070 | | | | 1.17 | | | | 1.17 | | | | | | | | | |
| Genapol C100 | | 1.49 | | | 1.49 | | | | 1.49 | | | 1.49 | | | 1.49 | | |
| Genapol C150 | | | | | | | | | | 2.54 | | | | | | 2.01 | |
| Genapol C200 | | | 2.54 | | | 2.54 | | | | | | | 2.54 | | | | 2.54 |
| Perfume | 0.9 | 0.9 | 0.9 | 1.8 | 1.8 | 1.8 | 1.8 | 1.8 | 1.8 | 1.8 | 2.13 | 2.13 | 2.13 | 2.67 | 2.67 | 2.67 | 2.67 |
| Sodium sulphate[a] | | | | | | | | | | | | | | 0.2 | 0.2 | 0.2 | 0.2 |
| Water | ← To 100% → | | | | | | | | | | | | | | | | |
| Softness Results | 1.5 | 1.8 | 1.9 | 1.8 | 1.1 | 1.3 | 1.13 | 1.13 | 0.38 | 0.38 | 0.8 | 0.6 | 0.5 | 1.5 | 1.0 | 0.5 | 0.7 |

[a]Added as a 10% aqueous solution.

The results show that when no oil was present, the softness performance worsened as the alkoxylation number of the nonionic stabiliser increased (compositions E to G).

Surprisingly, when a fixed amount of oil was present, the softening performance of the composition was observed to improve as the alkoxylation number of nonionic stabiliser increased (compositions 10 to 12, 13 to 16, 17 to 19 and 20 to 23).

Thus there is an unexpected synergy between the oil and nonionic alkoxylate on softening performance.

TABLE 3

| Composition | 24 | 25 | 26 | 27 | 28 |
|---|---|---|---|---|---|
| Arquad 2-HT | 13.5 | 13.5 | 13.5 | 13.5 | 13.5 |
| Sirius M85 | 26.5 | 26.5 | 26.5 | 26.5 | 26.5 |
| Genapol C050 | 0.97 | | | | |
| Genapol C070 | | 1.17 | | | |
| Genapol C100 | | | 1.49 | | |
| Genapol C150 | | | | 2.01 | |
| Genapol C200 | | | | | 2.54 |
| Perfume | 2.67 | 2.67 | 2.67 | 2.67 | 2.67 |
| Sodium Sulphate[a] | 0.2 | 0.2 | 0.2 | 0.2 | 0.2 |
| Water | ← To 100 → | | | | |
| Softening Result | 1.12 | 1.12 | 1.25 | 0.37 | 0.25 |

[a]Added as a 10% aqueous solution.

The same synergistic effect is demonstrated in table 3.

The results further show that the improvement on the softening performance of the composition is very substantial when the alkoxylate number of the nonionic stabiliser is greater than 10.

Perfume Intensity

Example 3

Evaluation of Hydrocarbon Oil Concentration on Perfume Intensity

The compositions were prepared according to method 2 above and added to a Tergotometer in a sufficient amount to give either 0.07% (compositions 29–34) or 0.21% (composition I) softener active on weight of cloth with a perfume level in the rinse liquor of about 4.8 mg/L.

Perfume delivery from the composition was evaluated by rinsing three pieces of terry towelling (20 cm×20 cm) per product in a similar manner to that previously described for softening evaluation of cloth treated in a tergotometer. In table 4a, perfume evaluation was carried out on the wet fabrics immediately following laundering. In table 4b, the treated cloth was spin dried to remove excess liquor and line dried for 24 hours, prior to perfume evaluation.

Perfume intensity on the cloth was evaluated by an expert panel who ranked the perfume intensity against set standards. The numbering system for the intensity of the perfume ranged from 1, denoting undetectable, to 5, denoting very strong perfume intensity.

TABLE 4a

| | Composition | |
|---|---|---|
| | 29 | I[a] |
| DEQA | 13.5 | |
| Sirius M85 | 13.5 | |
| Genapol C200 | 2.5 | |
| Servamine KAC 458 | 0.5 | |
| Perfume | 2.67 | |
| Preservative, dye, antifoam | Minor | |
| Water | To 100 | |
| Perfume Intensity | 4 | 3.5 |

[a]Commercially available dilute fabric softening composition comprising 5 wt % DEQA, bought in GB February 2000.

TABLE 4b

| | Composition | | | | | |
|---|---|---|---|---|---|---|
| | 30 | 31 | 32 | 33 | 34 | I[a] |
| DEQA | 13.5 | 13.5 | 13.5 | 13.5 | 13.5 | |
| Sirius M85 | 13.5 | 15.5 | 18.5 | 22.5 | 26.5 | |
| Genapol C20O | 2.0 | 2.0 | 2.0 | 2.0 | 2.0 | |
| Servamine KAC 458 | 1.0 | 1.0 | 1.0 | 1.0 | 1.0 | |
| Perfume | 2.67 | 2.67 | 2.67 | 2.67 | 2.67 | |
| Sodium sulphate[b] | | | | 0.05 | 0.05 | |
| Water | To 100 | To 100 | To 100 | To 100 | To 100 | |
| Perfume Intensity | 2 | 2.1 | 2.0 | 2.0 | 2.3 | 1.5 |

[a]See above
[b]Added as a 10% aqueous solution.

The results show that both on wet, just laundered fabrics and on dry fabrics 24 hours after laundering the intensity of perfume delivered by the compositions of the invention onto the fabric is greater than the intensity of perfume delivered by the commercially available fabric softener.

This is surprising since the amount of cationic softener deposited onto the fabric from the compositions of the invention was significantly lower than the amount deposited from the comparative composition (and thus it would be expected that the perfume intensity would reduce in line with the reduction of the level of deposition of the cationic softener).

Dispersion Test

Example 4

Evaluation of Oil Concentration on Dispersion of Compositions

The compositions were prepared according to method 2 above. Dispersion of compositions was assessed by turbidity measurements. Equal weights of the compositions were added to stirred water at 10° C. and the change in turbidity (i.e. decrease in light intensity) was measured over time. A turbidity curve was achieved which initially rose as dispersion took place, then reached a plateau when dispersion was complete. To assess the rate of dispersion the turbidity after 12 seconds compared to the turbidity plateau was expressed as "% dispersion" after 12 seconds.

The effect of the level of oil present in the compositions on their dispersion at 10° C. was evaluated. This was compared to the dispersion of a commercially available fabric softening composition also at 10° C.

The results are given in table 5.

TABLE 5

| | Composition | | | | |
|---|---|---|---|---|---|
| | 35 | 36 | 37 | 38 | J[a] |
| DEQA | 13.5 | 13.5 | 13.5 | 13.5 | |
| Sirius M85 | 6.5 | 11.5 | 16.5 | 26.5 | |
| Genapol C200 | 0.75 | 0.75 | 0.75 | 0.75 | |
| Perfume | 2.16 | 2.16 | 2.16 | 2.16 | |
| Calcium chloride[b] | 0 | 0 | 0 | 0.1 | |
| Water | To 100 | To 100 | To 100 | To 100 | |
| Viscosity (mPa · s) | 70 | 205 | 97 | 197 | 45 |
| Dispersion[c] | 97 | 88 | 95 | 100 | 97 |

[a]Commercially available concentrated fabric softening composition comprising 13.5% DEQA, bought in GB June 1999.
[b]Added as an 11% aqueous solution.
[c]Percentage of the fully dispersed product after 12 seconds.

The results show that all of the compositions of the invention disperse adequately and generally as well as the commercially available composition, even though the viscosities of the compositions of the invention are significantly higher than the viscosity of the comparative example.

Viscosity Test

Example 5 (Evaluation of the Oil Concentration and Alkoxylate Number of the Nonionic Stabiliser on Viscosity)

The compositions were prepared according to method 2 above and their viscosities measured at 25.4° C. at a shear rate of 106 $s^{-1}$ using a HAAKE viscometer RV20 with NV cup and bob.

The results are given in table 6.

TABLE 6

| | Composition | | | | | | | | | | | | | |
|---|---|---|---|---|---|---|---|---|---|---|---|---|---|---|
| Ingredient[a] | K | L | M | N | P | 39 | 40 | 41 | 42 | 43 | 44 | 45 | 46 | 47 |
| DEQA | 13.5 | 13.5 | 13.5 | 13.5 | 13.5 | 13.5 | 13.5 | 13.5 | 13.5 | 13.5 | 13.5 | 13.5 | 13.5 | 13.5 |
| Sirius M85 | 0 | 0 | 0 | 0 | 0 | 13.5 | 13.5 | 13.5 | 13.5 | 18.5 | 18.5 | 18.5 | 26.5 | 26.5 |
| Genapol C050 | 0.97 | | | | | 0.97 | | | | 0.97 | | | | |
| Genapol C070 | | 1.17 | | | | | 1.17 | | | | | | | |
| Genapol C100 | | | 1.49 | | | | | 1.49 | | | 1.49 | | 1.49 | |
| Genapol C150 | | | | 2.01 | | | | | | | | | | |
| Genapol C200 | | | | | 2.54 | | | | 2.54 | | | 2.54 | | 2.54 |
| Perfume | 0.9 | 0.9 | 0.9 | 0.9 | 0.9 | 1.8 | 1.8 | 1.8 | 1.8 | 2.13 | 2.13 | 2.13 | 2.67 | 2.67 |
| Sodium sulphate[b] | | | | | | | | | | | | | 0.2 | 0.2 |
| Water | To 100 | To 100 | To 100 | To 100 | To 100 | To 100 | To 100 | To 100 | To 100 | To 100 | To 100 | To 100 | To 100 | To 100 |
| Viscosity (cps) | 35 | 38 | 36 | 35 | 37 | 95 | 135 | 225 | 180 | 175 | 260 | 330 | 150 | 200 |

[a]Materials expressed as % mass of composition
[b]Added as a 10% aqueous solution.

The results show that when no oil was present, the level of nonionic stabiliser present had substantially no effect on the viscosity (see compositions K to P), whereas when fixed levels of the oil were present, the viscosity increased with the increasing level of the nonionic stabiliser.

Thus, the presence of the oil together with the nonionic alkoxylate enables the viscosity to be modified in a simple manner by selecting the amount of the nonionic stabiliser.

Stability Performance

Example 6

Evaluation of the Concentration of the Single Long Hydrocarbyl Chain Cationic Surfactant on Stability The following compositions were prepared according to method 2 above.

The compositions were then stored at 4° C., ambient and 37° C. Their appearance and pourability after 24 hours storage was observed. The results are given in table 7.

TABLE 7

| | Composition | | | | | | | |
|---|---|---|---|---|---|---|---|---|
| Ingredient | 48 | 49 | 50 | 51 | 52 | 53 | 54 | 55 |
| DEQA | 13.5 | 13.5 | 13.5 | 13.5 | 13.5 | 13.5 | 13.5 | 13.5 |
| Sirius M85 | 26.5 | 26.5 | 26.5 | 26.5 | 26.5 | 26.5 | 26.5 | 26.5 |
| Genapol C200 | 0.75 | 0.75 | 0.75 | 0.75 | 0.75 | 0.75 | 0.75 | 0.75 |
| Perfume | 2.16 | 2.16 | 2.16 | 2.16 | 2.16 | 2.16 | 2.16 | 2.16 |
| Servamine KAC 458 | 0 | 0.25 | 0.5 | 0.75 | 1.0 | 2.5 | 5.0 | 10.0 |
| Water | To 100 | To 100 | To 100 | To 100 | To 100 | To 100 | To 100 | To 100 |
| Viscosity at 4° C. | Solid | V.Thick, Pourable | V.Thick, Pourable | Solid | Pourable | Thick, Pourable | Solid | Solid |
| Viscosity at ambient | Pourable | Pourable | Pourable | Pourable | Pourable | Pourable | Solid | Solid |
| Viscosity at 37° C. | V.Thick, Pourable | V.Thick, Pourable | Thick, Pourable | Pourable | Pourable | Solid | Solid | Solid |

Another composition within the scope of the present invention is given in table 8.

TABLE 8

| Ingredient | Amount (% by weight) |
|---|---|
| DEQA | 13.5 |
| Castor Oil | 13.5 |
| Genapol C200 | 0.5 |
| Tallow Alcohol | 2.5 |
| Water | To 100 |

The composition in table 8 was prepared by co-melting the DEQA, oil, nonionic stabilise and tallow alcohol, heating the water to 70° C., adding the co-melt to the water under shear and mixing until a homogeneous emulsion was formed.

The invention claimed is:

1. An aqueous fabric softening composition comprising:

(i) about 11% to about 21% by weight based on the weight of said composition of a cationic fabric softening agent comprising at least two long hydrocarbyl chains;

(ii) about 10% to about 35% by weight based on the weight of said composition of one or more hydrocarbon oils comprising from 11 to 30 carbon atoms; and (iii) one or more nonionic stabilisers comprising 0.5% to 2.7% by weight based on the weight of said composition of an alkoxylated alcohol having an average alkoxylation number of from 11 to 40; and (iv) a single long hydrocarbyl chain cationic surfactant;

wherein the weight ratio of said oil to said nonionic stabilizer is about 60:1 to about 1:10; and wherein the composition is in the form of a macro-emulsion.

2. An aqueous fabric softening composition according to claim 1 in which the fabric softening compound comprises a quaternary ammonium group and at least one ester link.

3. A fabric softening composition according claim 1 where the single long chain hydrocarbyl cationic surfactant is present at a level from 0.01 to 5% by weight, based on the total weight of the composition.

4. A fabric softening composition according to claim 1 further comprising perfume.

5. A process for producing an aqueous fabric softening composition comprising mixing one or more cationic fabric softening agents comprising two or more long hydrocarbyl chains with about 10% to about 35% by weight based on the weight of said composition of one or more hydrocarbon oils comprising from 11 to 30 carbon atoms and with one or more nonionic stabilisers comprising 0.5 to 2.7 by weight based on the weight of said composition of an alkoxylated alcohol having an average alkoxylation number of from 11 to 40 so as to form a fabric softening composition in the form of a macro-emulsion comprising about 11% to about 21% by weight of the cationic fabric softening agent based on the weight of the composition.

* * * * *

UNITED STATES PATENT AND TRADEMARK OFFICE

CERTIFICATE OF CORRECTION

PATENT NO. : 7,015,188 B2
DATED : March 21, 2006
INVENTOR(S) : Adama et al.

It is certified that error appears in the above-identified patent and that said Letters Patent is hereby corrected as shown below:

Title page,
Item [75], Inventors, first inventor name should read -- Adams --.

Signed and Sealed this

Thirtieth Day of May, 2006

JON W. DUDAS
*Director of the United States Patent and Trademark Office*